United States Patent [19]

Di Amico

[11] Patent Number: 5,005,293

[45] Date of Patent: Apr. 9, 1991

[54] TWISTING PASTA FORK

[76] Inventor: Paul A. Di Amico, 500 E. Palm Canyon, Palm Springs, Calif. 92264

[21] Appl. No.: 428,908

[22] Filed: Oct. 30, 1989

[51] Int. Cl.[5] ..... A47J 43/28; A47J 43/04

[52] U.S. Cl. ..... 30/322; 30/148

[58] Field of Search ..... 30/322, 323, 340, 137, 30/147, 148; 408/199, 187, 158, 159, 161, 165; 81/DIG. 2, 59.1

[56] References Cited

U.S. PATENT DOCUMENTS

| | | | |
|---|---|---|---|
| 1,256,288 | 2/1918 | Barnes et al. | 81/DIG. 2 |
| 2,300,392 | 11/1942 | Austin | 81/DIG. 2 |
| 2,455,434 | 3/1947 | Mikelson | 81/DIG. 2 |
| 2,710,449 | 6/1955 | Crino | 30/322 |
| 3,552,017 | 1/1971 | Smuts | 30/322 |

FOREIGN PATENT DOCUMENTS

| | | | |
|---|---|---|---|
| 1007199 | 5/1952 | France | 81/DIG. 2 |

*Primary Examiner*—Douglas D. Watts
*Assistant Examiner*—Paul M. Heyrana, Sr.
*Attorney, Agent, or Firm*—Roger A. Marrs

[57] ABSTRACT

A dining fork is disclosed herein having an elongated hollow sleeve open at one end to insertably receive a shaft having a fork end. A spring element forcibly urges the shaft out of the sleeve and a spiral mechanism twists the shaft and fork end as the shaft exits the sleeve. The mechanism includes a ratchet, ball and socket or other devices for retaining the shaft in the sleeve during an eating procedure when food is captured on the fork end.

1 Claim, 1 Drawing Sheet

TWISTING PASTA FORK

BACKGROUND OF THE INVENTION

1. Field of the Invention

The present invention relates to the field of culinary equipment and more particularly to a novel fork having the ability to twist while in the user's hand for the collection of food thereon preparatory to eating the food.

2. Brief Description of the Prior Art

In the past, it has been the conventional practice to use a fork placed in the hand of the user whereby the user's hand is turned and twisted so as to gather food, such as spaghetti, pasta or the like onto the tines of the fork. Once the gathering has been completed, the fork is then lifted and the food consumed from its collected state on the end of the fork. The conventional fork includes an end carrying the tine and an elongated handle portion which is conveniently placed in the hand of the user. There is no separation or relative movement between the parts of the fork so that the only twisting motion is done by the wrist and hand of the user.

Although some attempts may be been made to employ an automatic twisting arrangement for the fork tines, problems and difficulties are oftentimes encountered which stem largely from the fact that the fork tines may only be turned or twisted to gather food wherein the turning or twisting is then restricted while the user raises the implement to his mouth to consume the collected food. Obviously, once the twist has been made, the food must be retained on the fork tines and no twisting or turning or rotational movement may be tolerated while the implement is being raised to the mouth of the user. Otherwise, the collected food will be dislodged causing embarrassment to the user.

Automatic means for effecting twist or rotation of the fork tines should also include a means for releasably fixing the tines in a particular location so that collected food will not be so dislodged. Also, the rotation or twisting of the fork tines is oftentimes difficult on conventional forks inasmuch as the length of the tines is all the same so that an effective central pivot is not afforded to the implement.

SUMMARY OF THE INVENTION

Accordingly, the above problems and difficulties are obviated by the present invention which provides a novel device for gathering food, such as pasta, onto the tines of a fork and that will hold the food thereon during the eating procedure. Such a device includes an elongated shaft which is insertably received into the interior of a sleeve through an open end thereon. The shaft is provided, in one form, with a spiral groove into which a fixed ball carried on the sleeve rotatably slides. The exposed end of the shaft out of the sleeve includes a fork end having a plurality of tines whereby central tines of the plurality are longer in length than the tines on the opposite sides thereof. Such longer tines provide a pivot whereby rotation of the fork end carrying the tines will readily rotate without binding or scraping. Means are provided on the sleeve and the shaft that cooperate to limit movement of the shaft with respect to the sleeve when food has been gathered thereon and such limiting means may take the form of a ratchet mechanism or a ball and socket mechanism. Resilient means are also provided operably disposed between the sleeve and the shaft for normally biasing the shaft so as to extend the fork tines outwardly and away from the sleeve. Such extension constitutes a starting position for gathering the pasta onto the fork tines, and when the shaft is recessed within the sleeve against full compression of the resilient means, the latch means releasably controls connection of the sleeve to the shaft so that the eating procedure can take place without dislodgement of the food from the gathered position on the fork tines.

Therefore, a long standing need has existed to provide an economical and convenient means for collecting pasta or other food commodities which rotates to gather the pasta, and which releasably locks in this position preparatory to eating.

Therefore, it is among the primary objects of the present invention to provide a novel culinary fork capable of twisting and gathering food, such as pasta, that will automatically gather the food and retain the food in place while the implement is being raised to the user's mouth.

Another object of the present invention is to provide novel twisting fork tines for gathering food under the control of the user's hand and which includes a releasable means, such as a ratchet or a ball and socket arrangement for preventing spinning or turning of the rotatable fork tine once food has been collected thereon.

Another object of the present invention is to provide an economic and convenient means for automatically gathering food onto the tines of a fork whereby the food may be readily consumed during a conventional culinary procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
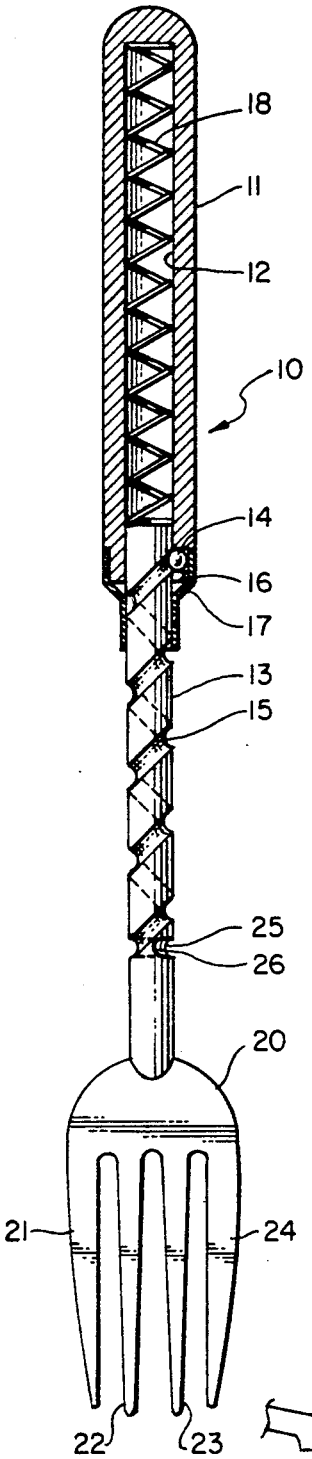
FIG. 1 is a front elevational view, partly in section, of the novel fork incorporating the present invention.
Figure 3:
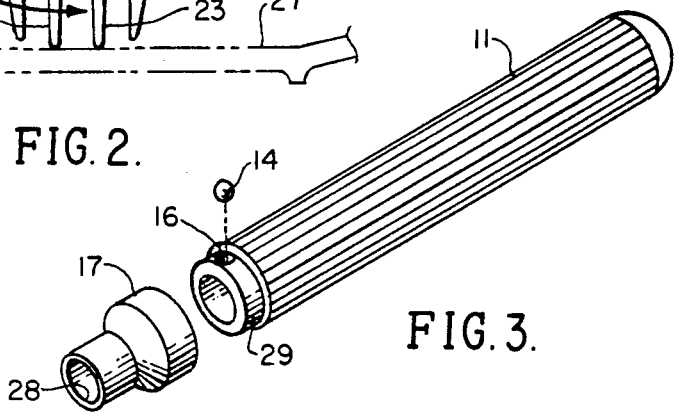
FIG. 3 is an exploded perspective view illustrating the mounting of a retention ball used in the latch mechanism of the present invention.

Referring to FIG. 1, the novel twisting fork of the present invention is illustrated in the general direction of arrow 10 which includes a hollow sleeve 11 having a central bore 12 into which a shaft 13 is insertably disposed for rectilinear movement as well as rotational. One end of the sleeve 11 adjacent to its open end includes a latch mechanism having a ball 14 that rides in a spiral groove 15 formed in the shaft 13. The ball 14 is captured within a hole or aperture 16, such as shown in FIG. 3, so that as pressure is moved on the sleeve 11 towards the shaft 13, the ball will cause the shaft to rotate or twist within bore 12. The ball is held within the opening or aperture 16 by means of a collar 17 fitted over the end of the sleeve 11. The shaft 13 is normally biased to the position shown in FIG. 1 by the means of an expansion resilient element 18 taking the form of a coil spring. The spring is compressible between the closed end of the sleeve 11 and the base of the shaft 13.

The opposite end of the shaft 13 from its end bearing against the spring 18 carries a fixed fork element 20 having a plurality of tines, such as indicated by the numerals 21, 22, 23 and 24. It is to be particularly noted that the center tines 22 and 23 are longer than the outside tines 21 and 24 so that as the shaft 13 rotates, the tines 22 and 23 become a central pivot. These tines are coaxially disposed with respect to the shaft 13 and the sleeve 11.

It is also to be noted that the end of spiral 15 adjacent to the fork element 20 terminates in a circular groove 25 into which the ball 14 enters so as to releasably retain and hold the shaft in a fixed position with respect to the sleeve 11. In this manner, food may be collected or gathered on the fork element 20 as the shaft 13 proceeds into the bore 12 of the sleeve 11 and rotation will take place as the ball 14 travels through the spiral groove 15. However, when the ball reaches the annular or circular groove 25, rotation will stop since the ball is captured within the circular groove and no linear movement of the shaft 13 can take place. It can be seen that the groove 25 includes a limit stop at one end, indicated by numeral 26, so that the shaft and sleeve are releasably latched together. In order to unlatch, the user merely taps or slightly shakes the implement so that the ball will travel from the annular groove 25 back into the spiral groove where upon expansion of the resilient means 18 will cause the implement to assume the position shown in FIG. 1.

Figure 2:
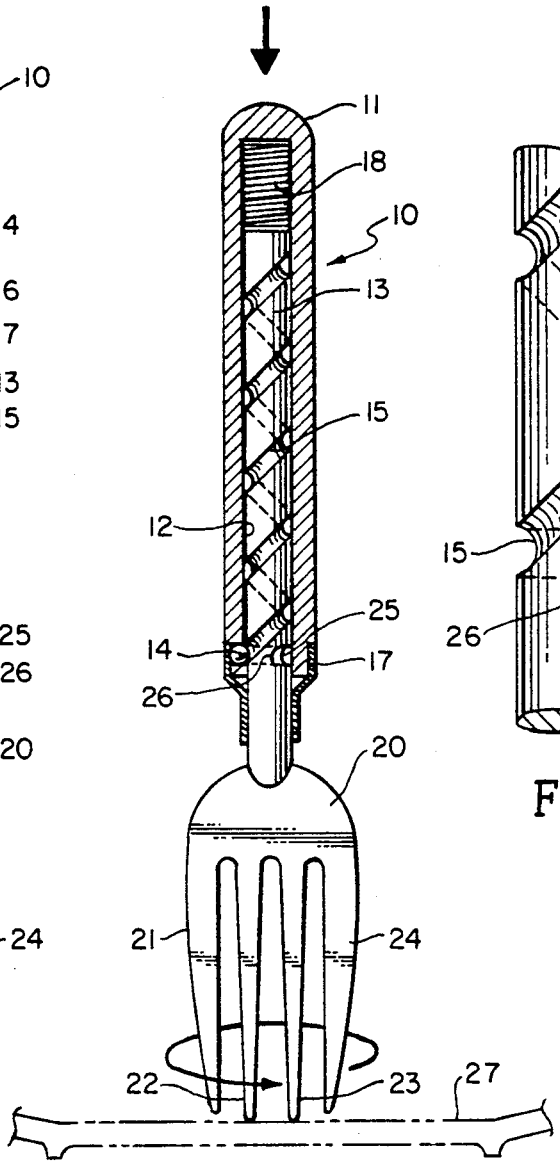
FIG. 2 is a view similar to the view of FIG. 1 illustrating the novel fork in its retracted position completing the gathering of food on the fork tines.

As illustrated in FIG. 2, the sleeve 11 operating as a handle has been moved in the direction of the arrow so that the ball 14 has traveled the full length of the spiral 15 which draws the shaft 13 into the bore of the sleeve against the expansion of the resilient means 18. Therefore, the resilient means is illustrated as being compressed and the latch ball 14 is illustrated as being within the annular groove 25.

FIG. 2 illustrates the second position of the eating utensil in that the spring has been compressed with the shaft completely or substantially completely within the bore of the sleeve 11. At this point, the latch is in place and the implement may be raised off a food supporting surface such as a dish 27. During the twisting of the fork element 20, the tines 22 and 23 are pressed against the surface of the dish 27 as the sleeve 11 is forced over the shaft 13 to compress the spring 18. Once the food has been gathered on the fork element 20, the user may then raise the fork to his mouth for food consumption without fear that the fork will spin or twist since the latch ball 14 is in the annular groove 25 and bearing against the stop 26. However, once completed, the tines may be tapped to the dish surface or shaken so that the ball will reenter the spiral groove 15 at which time the spring 18 will automatically expand and cause the sleeve 11 to assume the position shown in FIG. 1 preparatory for gathering food on the fork element 20 again.

As shown in FIG. 3, the ball is placed within the opening or aperture 16 on a reduced end 27 of the sleeve 11. The collar 17 slides over the reduced end 27 to retain the ball in position. The collar 17 includes an opening 28 for rotatably and slidably receiving the shaft 13.

Figure 4:
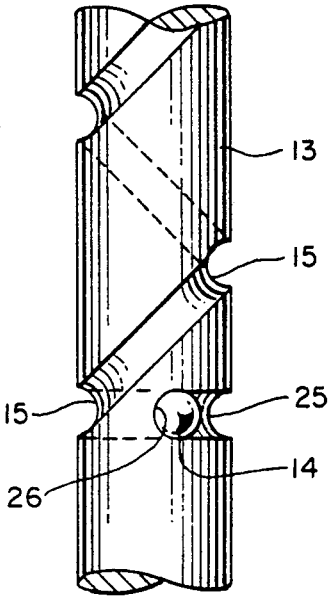
FIG. 4 is an elongated view of the retention ball employed in the latch mechanism.

FIG. 4 is an enlarged view and shows the retention of the shaft 13 with the sleeve 11 as indicated in FIG. 2 by the latch ball 14 being in the groove 25 and bearing against the stop 26. By tapping or shaking, the user can move the ball latch 14 away from the stop 26 along groove 25 until the ball reaches the end of the spiral groove 15. At this time, the expansion of spring 18 takes over and urges the handle 11 upwardly over the sleeve 13 into the position shown in FIG. 1.

In actual operation, the eating implement operates on a principle similar to that of a ratchet screwdriver or the like. The shaft of the fork may be a ratchet covered by the sleeve so as to conceal the working mechanism and a separate finger-operated release for the ratchet may be employed. However, as illustrated, the latch means includes the ball and groove arrangement and concealment takes place by the sleeve 11 and the collar 17. The fork, when held in the hand of the user who applies a downward pressure on sleeve 11 against the plate 27, creates a twisting motion rotating the tines and rotating particularly about the central tines 22 and 23. Thus, pasta, noodles or other food materials are gathered around the fork element 20. The ratchet or ball latch means is spring-loaded so as to return to a neutral position, as shown in FIG. 1 after the full gathering position shown in FIG. 2.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An eating utensil for gathering food such as pasta comprising:

a stationary hollow sleeve having a closed end and an open end leading into a central bore;

a movable fork element having an elongated shaft insertably disposed within said sleeve bore in slideable and rotational relationship;

a plurality of elongated tines carried on said fork element in fixed spaced-apart relationship for collection of pasta thereon;

resilient means operably carried in said sleeve bore between said sleeve closed end and said shaft normally urging said shaft out of said sleeve;

latch member releasably coupled between said shaft and sleeve securing said shaft to said sleeve against said resilient means in one shaft position and unsecuring said shaft from securement with said sleeve in a second shaft position;

said latch means includes a spiral groove about said shaft slideably receiving a ball carried on said sleeve partially disposed within said spiral groove;

said latch means further includes means cooperating between said shaft and said sleeve for releasing said shaft for movement between said first and said second positions;

said latch means further includes an annular groove at the end of said spiral groove adjacent said fork element; and a limit stop provided on said shaft end to said annular groove to stop said ball in order to secure said shaft in said first position.

* * * * *